US006516143B2

(12) United States Patent
Toya et al.

(10) Patent No.: US 6,516,143 B2
(45) Date of Patent: Feb. 4, 2003

(54) FLUID HEATING APPARATUS

(75) Inventors: Eiichi Toya, Yamagata (JP); Tomio Konn, Yamagata (JP); Tomohiro Nagata, Yamagata (JP); Sunao Seko, Yamagata (JP); Takanori Saito, Kanagawa (JP); Kazutoshi Miura, Kanagawa (JP); Harunari Hasegawa, Kanagawa (JP); Joji Hoshi, Kanagawa (JP); Katsutoshi Ishii, Kanagawa (JP)

(73) Assignees: Toshiba Ceramics Co., Ltd., Tokyo (JP); Tokyo Electron Limited, Tokyo (JP)

( * ) Notice: Subject to any disclaimer, the term of this patent is extended or adjusted under 35 U.S.C. 154(b) by 118 days.

(21) Appl. No.: 09/819,702

(22) Filed: Mar. 29, 2001

(65) Prior Publication Data

US 2002/0023919 A1 Feb. 28, 2002

(30) Foreign Application Priority Data

| | | |
|---|---|---|
| Mar. 30, 2000 | (JP) | 2000-093245 |
| Jan. 11, 2001 | (JP) | 2001-003250 |
| Feb. 15, 2001 | (JP) | 2001-038424 |

(51) Int. Cl.[7] ..... H05B 3/02

(52) U.S. Cl. ..... 392/480; 392/465; 392/487; 219/544

(58) Field of Search ..... 392/465, 473, 392/478–484, 485, 487; 219/552, 544

(56) References Cited

U.S. PATENT DOCUMENTS

| | | | | |
|---|---|---|---|---|
| 1,369,900 A | * | 3/1921 | Macy | 338/218 |
| 2,775,683 A | * | 12/1956 | Kleist | 222/146.3 |
| 3,679,364 A | * | 7/1972 | Teal et al. | 422/79 |
| 6,407,371 B1 | * | 6/2002 | Toya et al. | 118/724 |

OTHER PUBLICATIONS

Junichi Hattori, "Manufacturing Apparatus for Semiconductor Device," Japanese 63–316425, Dec. 23, 1988, Patent Abstracts of Japan, Japanese Patent Office.

Mitsuhiro Hirano, "Reaction Furnace with Reaction Gas Preheater," Japanese Publication No. 07–176498, Jul. 14, 1995, Patent Abstracts of Japan, Japanese Patent Office.

* cited by examiner

*Primary Examiner*—Teresa Walberg
*Assistant Examiner*—Thor Campbell
(74) *Attorney, Agent, or Firm*—Foley & Lardner

(57) ABSTRACT

The fluid heating apparatus, in accordance with the present invention, developed to solve the technological problems described above is characterized by comprising at least a heating tube heating fluid to be supplied from fluid supply source, a heater section spirally formed on an outer periphery of the heating tube and a housing accommodating the heating tube and the heater section, wherein the heater section comprises a carbon wire heating element and a quartz glass tube in which the carbon wire heating element is enclosed.

22 Claims, 12 Drawing Sheets

(a)

(a)

(b)

(a)

(b)

(a)

(b)

FLUID HEATING APPARATUS

BACKGROUND OF THE INVENTION

1. Field of the Invention

The present invention relates to a fluid heating apparatus for gas or liquid, for example, to a fluid heating apparatus, connected with various semiconductor heating treatment furnaces used in semiconductor manufacturing process, controlling temperature of gas supplied to the semiconductor heating treatment furnaces.

2. Description of the Related Art

In semiconductor manufacturing process, for example, in an impurity diffusion furnace, an oxidation furnace, an annealer, a thin film deposition system, an etching system and the like, various semiconductor heating treatment furnaces are used. In these semiconductor heating treatment furnaces, various types such as single wafer processing type, vertical type, horizontal batch processing type are present corresponding to object and use.

Conventional vertical batch processing oxidation reaction furnace will be described based on FIG. 12. This reaction furnace 60 is comprised of a reaction tube heating furnace 61, a liner tube 62 and a reaction tube 63 and constituted so that wafer boat (not shown) supporting wafer by multistage can be arranged in the reaction tube 63.

In such a reaction furnace 60, reacting gas is introduced from a reacting gas inlet 64 through a reacting gas nozzle 65 and a gas introducing section 66 provided in the reaction tube heating furnace 61 into the reaction tube 63.

In conventional vertical batch processing oxidation reaction furnace 60, reacting gas is pre-heated by heat of a heater (not shown) embedded in the reaction tube heating furnace via the liner tube 62 when passing through the gas introducing section 66, and temperature thereof rise.

However, temperature of reacting gas introduced from the external is low compared with that inside the reaction tube 63, and reacting gas is not heated enough, therefore temperature difference occurs, thereby partial pressure distribution of decomposition product gas of reacting gas in the reaction tube 63 become uneven.

As a result, there are abuse that reaction difference between wafers contained inside the reaction tube 63 is produced, thereby film thickness and quality of film become uneven which are generated in the wafers, therefore excellent oxide film can not be obtained.

As the method to solve above-mentioned abuse, it is suggested that reacting gas is heated to a predetermined temperature corresponding to a process temperature of the semiconductor heating furnace by a heating device before introduction into the furnace to uniform temperature distribution in the furnace (JP-A 63-316425, JP-A 7-176498).

A gas heating apparatus which heat-controls reacting gas to be introduced in a vertical reaction furnace to a predetermined temperature is disclosed in JP-A7-176498. Here, this gas heating apparatus will be described based on FIG. 13. This gas heating apparatus 70 is comprised of a heating path portion 73 formed in snake-like and a temperature uniformity matter (heating matter) 72 provided in the heating path portion 73, and constituted so that reacting gas introduced from a gas inlet 71 is heated by the temperature uniformity matter (heating matter) 72 of the gas heating apparatus to flow in the long narrow heating path portion 73 formed in snake-like to introduce into the furnace.

Here, the arrow in FIG. 13 shows the flow of reacting gas.

A gas heating apparatus which heat-controls reacting gas to be introduced into an epitaxial thin film vapor phase growth system using a single wafer processing furnace to predetermined temperature is disclosed in JP-A 63-316425.

Here, this gas heating apparatus will be described based on FIG. 14, FIG. 15. This gas heating apparatus 80 is comprised of a spiral tube 81 and a heater section 82 provided outside of the spiral tube 81, and constituted so that reacting gas is heated to predetermined temperature by heat from the heater section 82 while reacting gas is passed through the spiral tube 81, and then reacting gas is supplied from a nozzle 83 to a belljar 84. Here, the arrow in FIG. 14, FIG. 15 shows the flow of reacting gas.

In the case where the gas heating apparatus disclosed in JP-A 7-176498 is applied to a oxidation furnace, if the heating path portion is made of high purity quartz tube, the temperature uniformity matter (heating matter) is made of heating element made of high purity silica carbide (SiC), since vapor (H2O) is used as reacting gas, and oxygen is entered into inside of SiC heating element to produce internal oxidation, thereby structural degradation and particle are generated, which has been problems.

And when hydrogen is flow in annealer, impurity gas is generated by reaction between SiC heating element and hydrogen, which has been a problem.

Furthermore, SiC heating element has large heat capacity and bad heat response, therefore rapid rise and fall of temperature is impossible.

In the gas heating apparatus disclosed in JP-A 63-316425, the apparatus is constituted so that reacting gas is passed through the spiral tube, however, gas is difficult to stay, if the length of the spiral tube is extended, reacting gas may be heated to predetermined temperature. On the other hand, when the length of the spiral tube is extended in order to heat gas to predetermined temperature, the gas heating apparatus can not be miniaturized.

SUMMARY OF THE INVENTION

The present invention is developed to solve the technological problems described above, it is an object of the present invention to provide a fluid heating apparatus which can improve durability, suppress generation of particle and the like or metallic contamination and the like and be miniaturized.

The fluid heating apparatus, in accordance with the present invention, developed to solve the technological problems described above is characterized by comprising at least a heating tube heating fluid to be supplied from fluid supply source, a heater section spirally formed on an outer periphery of the heating tube and a housing accommodating the heating tube and the heater section, wherein the heater section comprises a carbon wire heating element and a quartz glass tube in which the carbon wire heating element is enclosed.

The constitution of the fluid heating apparatus in accordance with the present invention is characterized in that the heater section comprises a carbon wire heating element and a quartz glass tube in which the carbon wire heating element is enclosed, and the heater section is spirally formed on an outer periphery of the heating tube.

This way, heat capacity of the heater section comprising the carbon wire heating element enclosed in the quartz glass tube is small compared to a conventional heater made of high purity SiC, and there is a small amount of generation of metallic contamination, particle and impurity gas harmful to semiconductor wafer.

Furthermore, heating efficiency and heat responsiveness in temperature rising operation of fluid are excellent because the heater section is spirally formed on the outer periphery of the heating tube, heating the fluid.

In addition, it is preferable that the fluid heating apparatus in accordance with the present invention is used as gas heating apparatus for heat controlling gas to be introduced in the semiconductor treatment furnace in the case where fluid is gas. Thus, it is more preferable that the fluid heating apparatus in accordance with the present invention is constituted as the heating apparatus, connected with a gas supply source and the semiconductor treatment furnace, comprising at least a heating tube heating gas to be supplied from gas supply source, a heater section spirally formed on an outer periphery of the heating tube and a housing accommodating the heating tube and the heater section, wherein the heater section comprises a carbon wire heating element and a quartz glass tube in which the carbon wire heating element is enclosed. This reduces variation in treatment temperature in the semiconductor treatment furnace and impurity contamination of the semiconductor wafer to be gas treated.

Here, it is desirable that filling which act as resistance for passing fluid is arranged inside the heating tube.

This way, suitable residence time can be added to passing fluid because filling which act as resistance for passing gas, for example, is arranged inside the heating tube.

As a result, fluid which pass inside the heating tube can obtain enough heat by radiation heat from the carbon wire heating element, which can rise temperature to a predetermined temperature. And the heating tube and the heater section can be miniaturized because it is possible to stay fluid passing inside the heating tube.

In addition, it is desirable that the filling comprises a molded matter formed by welding short column-like quartz glass beads or a porous quartz glass molded matter in which communicated pore is formed.

Particularly, it is desirable that the molded matter which are formed by welding short column-like quartz glass beads is the molded matter formed by mixing large and small, two kinds of beads having a diameter of 6 to 12 mm and a length of 6 to 12 mm and breads having a diameter of 4 to 10 mm and a length of 4 to 10 mm at the number ratio of 1:4 to 4:1 (more preferably at the ration of 6:4 to 8:2) to weld.

This way, since filling comprising the molded matter formed by welding quartz glass beads or the porous quartz glass molded matter in which communicated pore is formed is arranged in the heating tube, suitable residence time is added by passage of gas introduced into the heating tube through fine pass, formed by filling, complicatedly distortedly intersected. In addition, radiation heat from the carbon wire heating element complicatedly repeat transmission, refraction, scattering, reflection inside the molded matter.

As a result, heat exchange efficiency may be improved, and the heating tube and the heater section may be miniaturized because enough quantity of heat may be added to introduced gas.

In addition, a large part of heat energy transmitted from the carbon wire heating element of the heater section into the heating tube is radiation heat because heat conductance of quartz matter such as quartz glass is not large. Therefore, it is preferable that filling inside the heating tube is transparent matter rather than black matter.

Because in the case of black matter, radiation is absorbed at the part of surface of black matter, thereby only the surface part is partially heated. On the other hand, in the case of transparent matter, radiation heat irradiated to transparent matter complicatedly transmit, reflect and refract to reach the center portion, thereby the inside of filling may be heated uniformly, and gas which pass through inside of the heating tube may be heated uniformly. Accordingly, it is preferable that quartz glass beads which is filling is comprised of transparent quartz glass.

It is also preferable that the filling is a plurality of quartz glass pipes or a gas disturbing plate, made of quartz glass, having a plurality of opening sections. In particular, it is desirable that a plurality of gas disturbing plates are accommodated inside the heating tube, and that plates are constituted so that opening sections of neighboring gas disturbing plates are not corresponded to each other at least.

The same effect as filling described above may be obtained even if such filling.

In addition, it is desirable that high purity heat insulating material is filled in space between the heater section and the housing.

Because heat insulating material is filled in the space, a fluid heating apparatus whose heat insulation properties, shading properties and heating efficiency are excellent may be obtained.

And it is desirable that the heating tube and the heater section are accommodated in a thermal shield provided in the housing. In particular, it is desirable that the thermal shield is cylindrical, and a reflecting heat insulating coat film including silica fine powder and alumina fine powder is formed at least inside surface thereof. In order to obtain a thermal shield effectiveness of this thermal shield, it is preferable to form a reflecting heat insulating coat film on the inside surface thereof. This way, because the heating tube and the heater section are accommodated in the thermal shield, made of quartz glass, provided in the housing, a fluid heating apparatus whose heat insulation properties, shading properties and heating efficiency are excellent may be obtained.

In particular, in the case where a reflecting heat insulating coat film including silica fine powder and alumina fine powder is formed inside surface of the thermal shield, not only excellent heat insulation properties and shading properties but also ability to trap impurity on the surface thereof may be obtained.

Furthermore, it is desirable that compounding ratio between silica fine powder and alumina fine powder of the reflecting heat insulating coat film is a parts by capacity of 3:1 to 3:7, and the coat film further includes titanium oxide fine powder.

Compounding ratio between silica fine powder and alumina fine powder is less than parts by capacity of 3:7, and if ratio of silica fine powder become small, ability to trap impurity on the surface of the film is reduced.

On the other hand, compounding ratio between silica fine powder and alumina fine powder is more than parts by capacity of 3:1, and if ratio of alumina fine powder become small, an abuse that surface crack and peeling in forming the coat film are easy to occur, arises because silica fine powder is too much.

And it is desirable that film thickness of the reflecting heat insulating coat film is within the range of 30 to 300 $\mu$m. When the thickness of the reflecting heat insulating coat film is less than 30 $\mu$m, heat insulation properties and shading properties become worse, and when that is more than 300 $\mu$m, layer-like crack is easy to occur on the coat film, thereby abuse that the coat film is easy to peel arises.

In addition, it is desirable that high purity heat insulating material is filled in space between thermal shield and the housing.

Because high purity heat insulating material is filled in space between thermal shield and the housing, a fluid heating apparatus whose heat insulation properties, shading properties and heating efficiency are excellent may be obtained.

And, in the present invention, the apparatus may be more miniaturized by constituting the housing itself by high purity heat insulating material.

And it is desirable that the carbon wire heating element is a knitted cord-like or braid-like carbon wire heating element comprising a plurality of fiber bundle wherein carbon fiber having a diameter of 5 to 15 $\mu$m is bundled braided. And it is desirable that included impurity quantity of carbon fiber in the carbon wire heating element is not more than 10 ppm as ash content.

This way, in the case where carbon wire heating element is formed in knitted cord-like or braid-like, tensile strength is high, durability in high temperature is excellent and the heating element may be deformed easily, thereby this heating element may be easily accommodated inside spiral shaped quartz glass tube constituting the heater section.

Furthermore, diffusion of impurity may be prevented because included impurity quantity of carbon fiber constituting the carbon wire heating element is not more than 10 ppm as ash content, which is high purity.

The fluid heating apparatus in accordance with the present invention, is characterized by comprising at least a heating tube heating fluid to be supplied from fluid supply source, a heater section spirally formed on an outer periphery of the heating tube and a housing accommodating the heating tube and the heater section, wherein the heater section comprises a carbon wire heating element and a quartz glass tube in which the carbon wire heating element is enclosed, and a porous molded matter formed by partially welding a plurality of quartz glass beads is arranged inside the heating tube.

Since such porous molded matter is arranged inside the heating tube, suitable residence time is added by passage of gas introduced into the heating tube through fine pass, formed by filling, complicatedly distortedly intersected. And radiation heat from the carbon wire heating element complicatedly repeat transmission, refraction, scattering, reflection inside molded matter.

As a result, heat exchange efficiency may be improved, and the heating tube and the heater section may be miniaturized because enough quantity of heat may be added to introduced gas.

In addition, quartz glass beads in the invention comprise various form such as column-like matter, spherical matter, rectangular parallelepiped matter comprising quartz glass or pipe-like matter, comprising quartz glass, in which hollow portion is formed. And the size of quartz glass beads is not limited particularly, if molded matter on which a plurality of quartz glass beads is welded may be formed in the heating tube.

Here it is desirable that the carbon wire heating element is a knitted cord-like or braid-like carbon wire heating element comprising a plurality of fiber bundle wherein carbon fiber having a diameter of 5 to 15 $\mu$m is bundled braided. And it is desirable that included impurity quantity of carbon fiber in the carbon wire heating element is not more than 10 ppm as ash content.

This way, in the case where carbon wire heating element is formed in knitted cord-like or braid-like, tensile strength is high, durability in high temperature is excellent and the heating element may be deformed easily, thereby this heating element may be easily accommodated inside spiral quartz glass tube constituting the heater section, thereby it becomes possible to make the heater section of this fluid heating apparatus design and arrange on an outer periphery portion of the heating tube with high accuracy.

Furthermore, diffusion of impurity may be prevented because included impurity quantity of carbon fiber constituting the carbon wire heating element is not more than 10 ppm as ash content, which is high purity.

Also, it is preferable that the heating tube and the heater section are accommodated in high purity heat insulating material provided in the housing. This causes heat efficiency to improve, and it becomes possible to miniaturize the housing.

DESCRIPTION OF THE PREFERRED EMBODIMENTS

One embodiment of the fluid heating apparatus in accordance with the present invention, particularly, in the case where gas is used as this fluid, will be described below in detail based on FIG. 1 to FIG. 10. In the present invention, a gas heating apparatus will be described below as the fluid heating apparatus.

Figure 1:
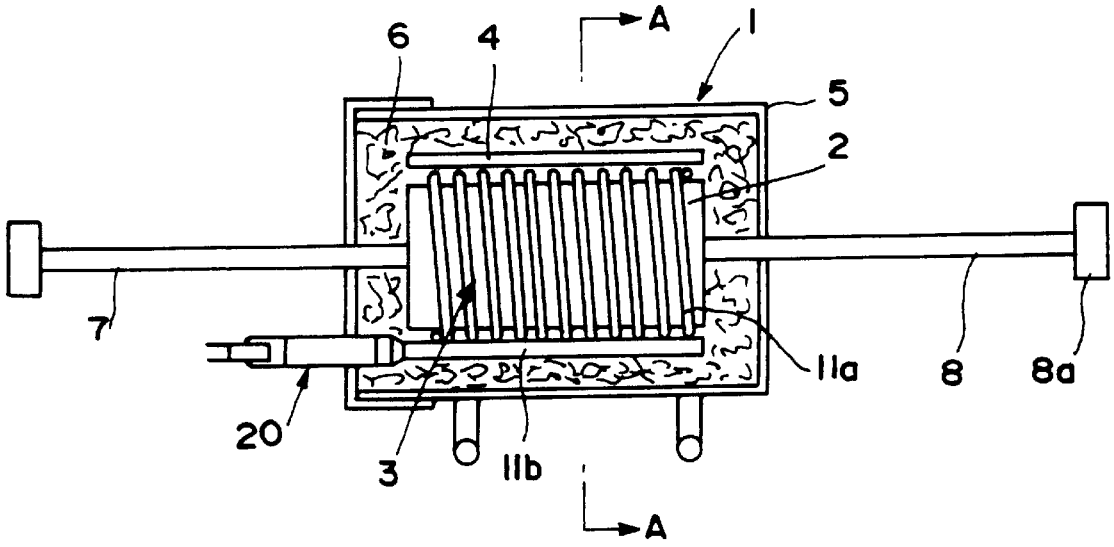
FIG. 1 shows an embodiment of a fluid heating apparatus (a gas heating apparatus) in accordance with the present invention, FIG. 1(*a*) is a side cross-sectional view, FIG. 1(*b*) is a cross-sectional view, taken along the line A—A of FIG. 1(*a*)
Figure 1:
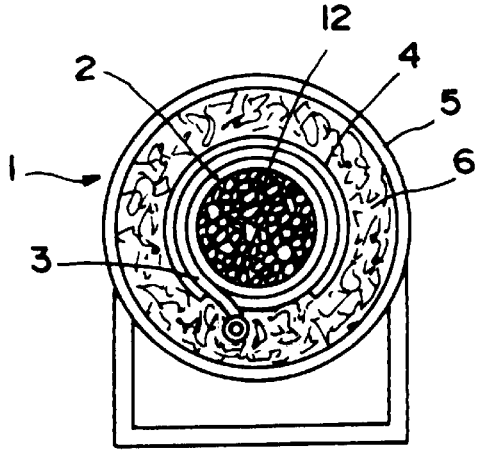
Figure 2:
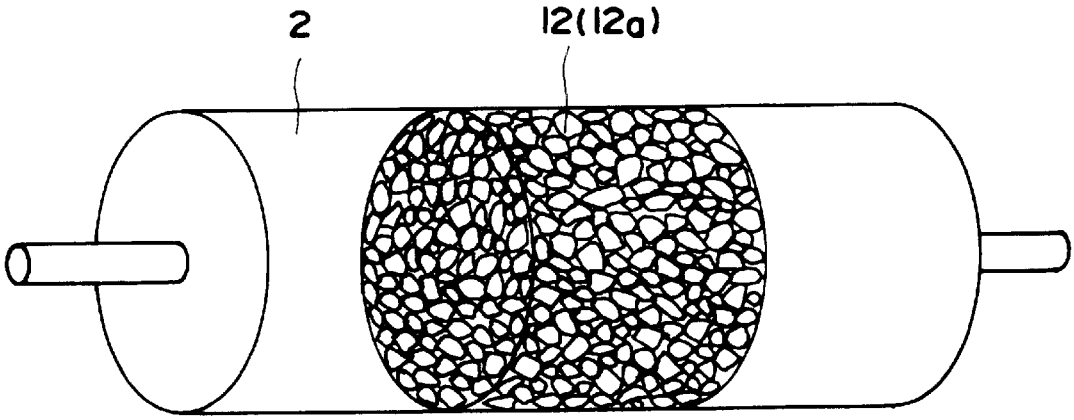
FIG. 2 shows a heating tube and filling used for the gas heating apparatus shown in FIG. 1, FIG. 2(*a*) shows filling in which short column-like quartz beads is welded, FIG. 2(*b*) shows porous quartz glass filling in which communicated pore is formed in foamed quartz glass.
Figure 2:
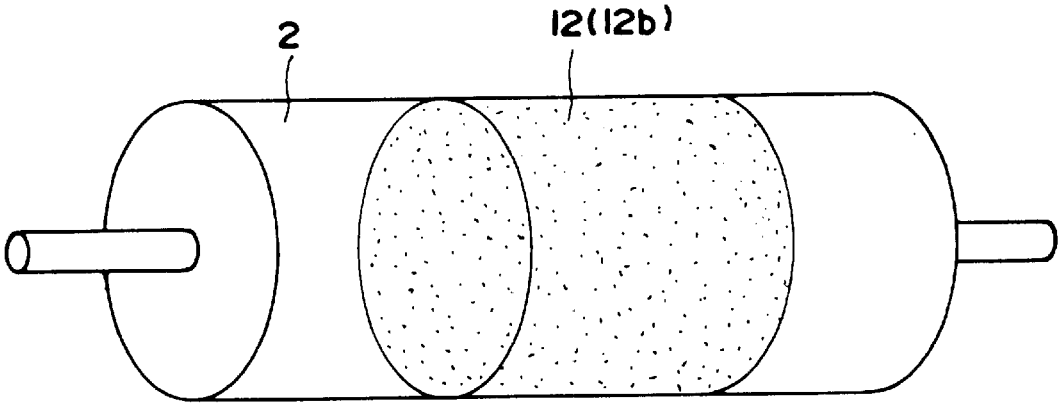
Figure 3:
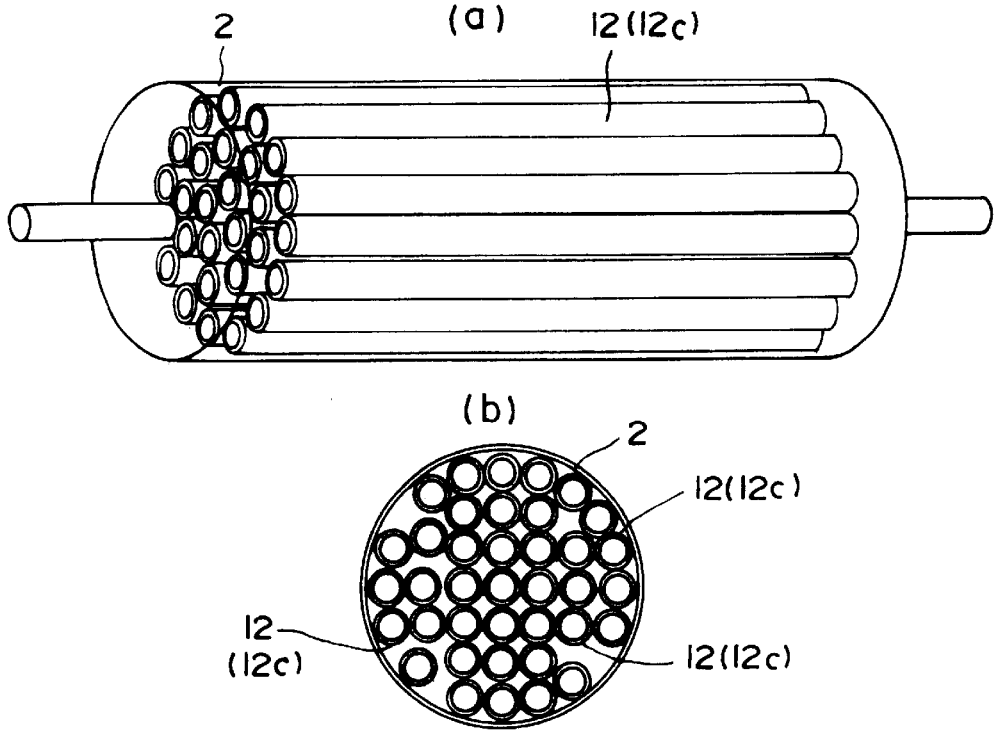
FIG. 3 shows the heating tube used for the gas heating apparatus shown in FIG. 1 and other example of filling, FIG. 3(*a*) shows filling comprising quartz pipes, FIG. 3(*b*) shows a front view of FIG. 3(*a*)
Figure 4:
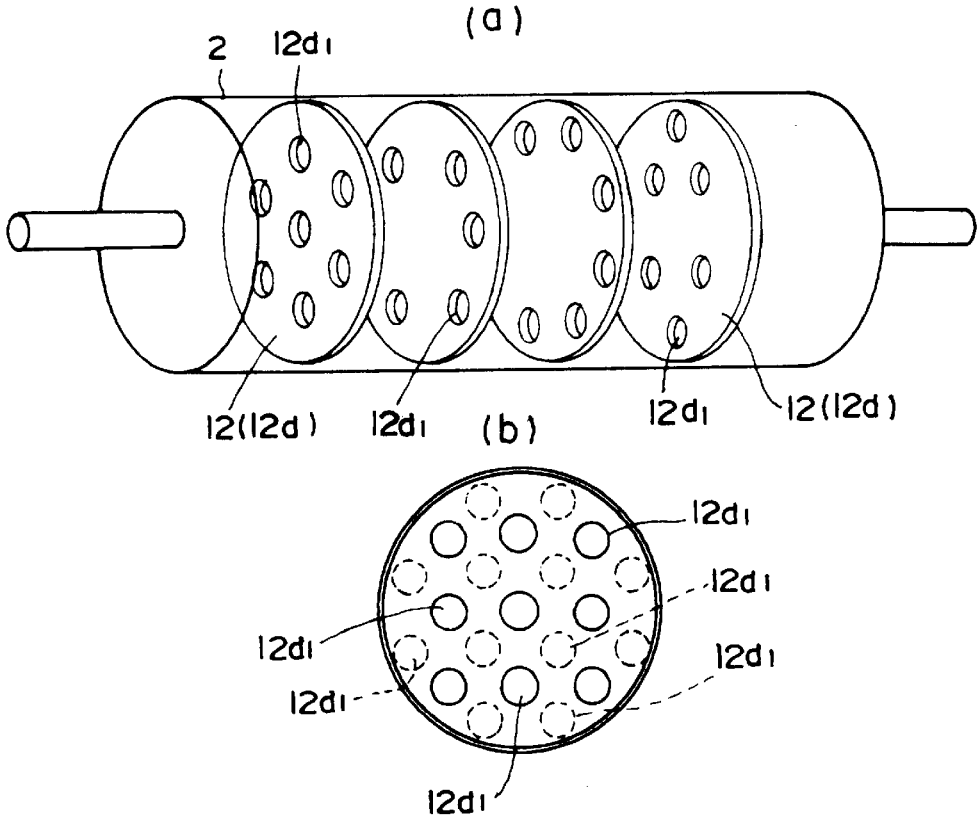
FIG. 4 shows the heating tube used for the gas heating apparatus shown in FIG. 1 and other example of filling, FIG. 4(*a*) shows the case where gas disturbing plates made of quartz are used as filling, FIG. 4(*b*) shows a front view of FIG. 4(*a*)

FIG. 1 shows an embodiment of the gas heating apparatus in accordance with the present invention, FIG. 1(*a*) is a side cross-sectional view, FIG. 1(*b*) is a cross-sectional view, taken along the line A—A of FIG. 1(*a*). FIG. 2 shows filling arranged in the heating tube, FIG. 2(*a*) shows filling comprising a molded matter in which short column-like transparent quartz glass beads is welded, FIG. 2(*b*) shows filling comprising a porous quartz glass molded matter that communicated pore is formed in foamed quartz glass. FIG. 3 shows filling arranged in the heating tube, as like FIG. 2, FIG. 3(*a*) shows filling comprising a molded matter in which transparent quartz glass pipes are welded, FIG. 3(*b*) shows a front view of FIG. 3(*a*). FIG. 4(*a*) shows filling comprising disturbing plates made of quartz glass, FIG. 4(*b*) shows a front view of FIG. 4(*a*).

Figure 5:
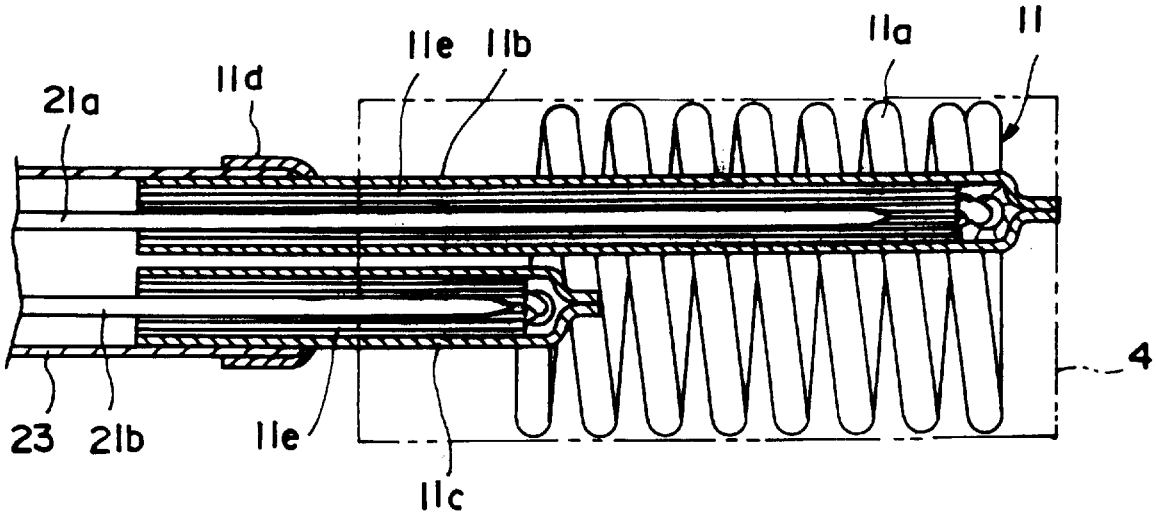
FIG. 5 shows structure of the heating tube used for the heater section of the gas heating apparatus shown in FIG. 1, FIG. 5(*a*) is a side partial cross-sectional view, FIG. 5(*b*) is a plan.
Figure 5:
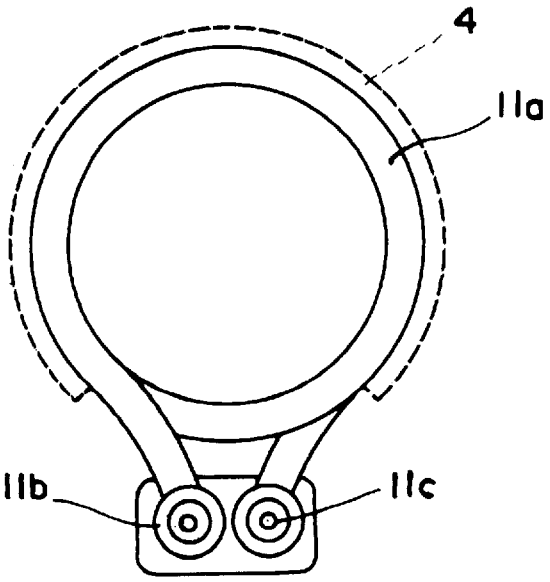

FIG. 5 shows structure of the heater section, FIG. 5(*a*) is a side partial cross-sectional view thereof, FIG. 5(*b*) is a plan thereof.

Figure 6:
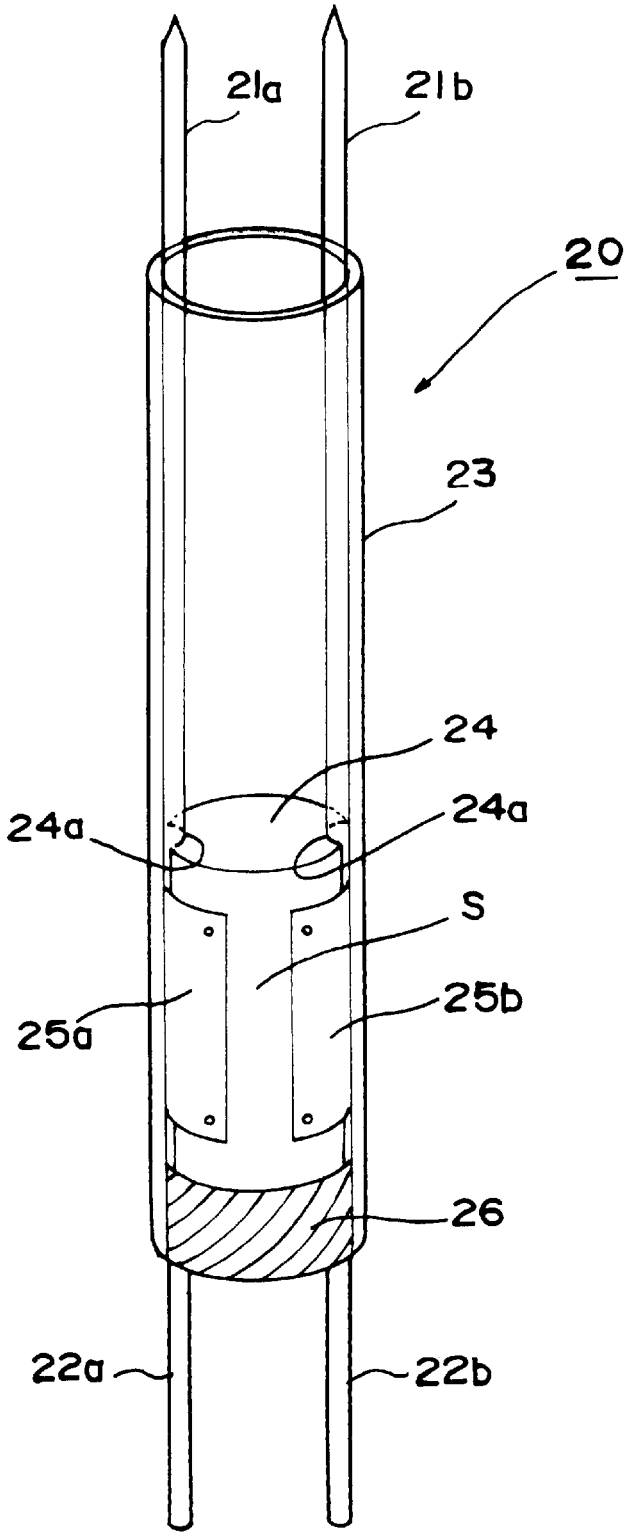
FIG. 6 is a perspective illustrating the structure of sealing terminal portion of the gas heating apparatus shown in FIG. 1.
Figure 7:
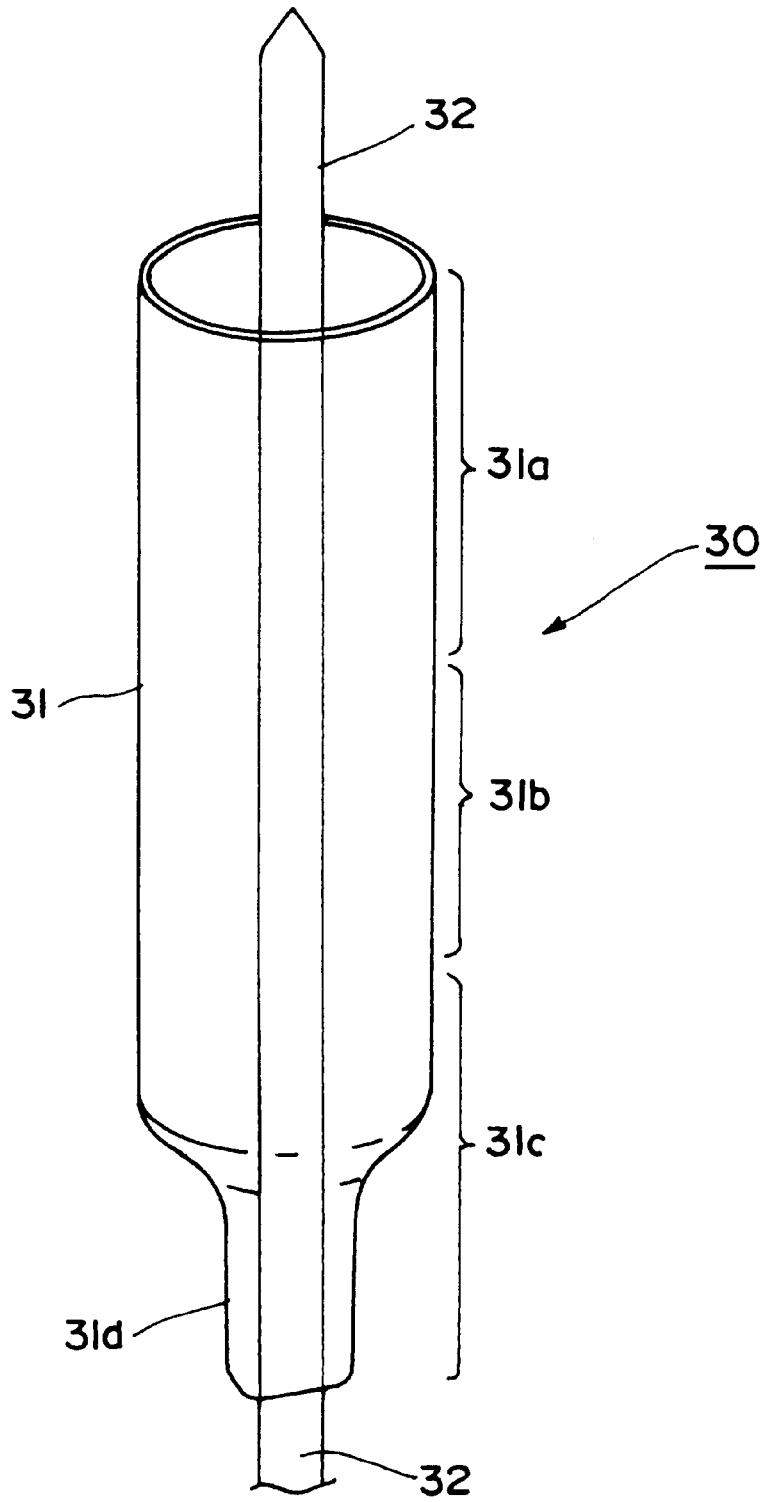
FIG. 7 is a perspective illustrating other example of the structure of sealing terminal portion of the gas heating apparatus shown in FIG. 1.
Figure 8:
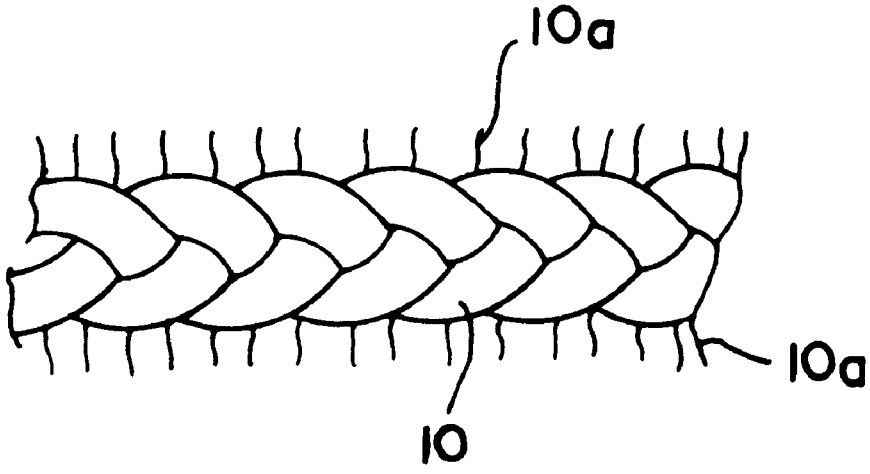
FIG. 8 is a schema illustrating a carbon wire heating element of the gas heating apparatus shown in FIG. 1.
Figure 9:
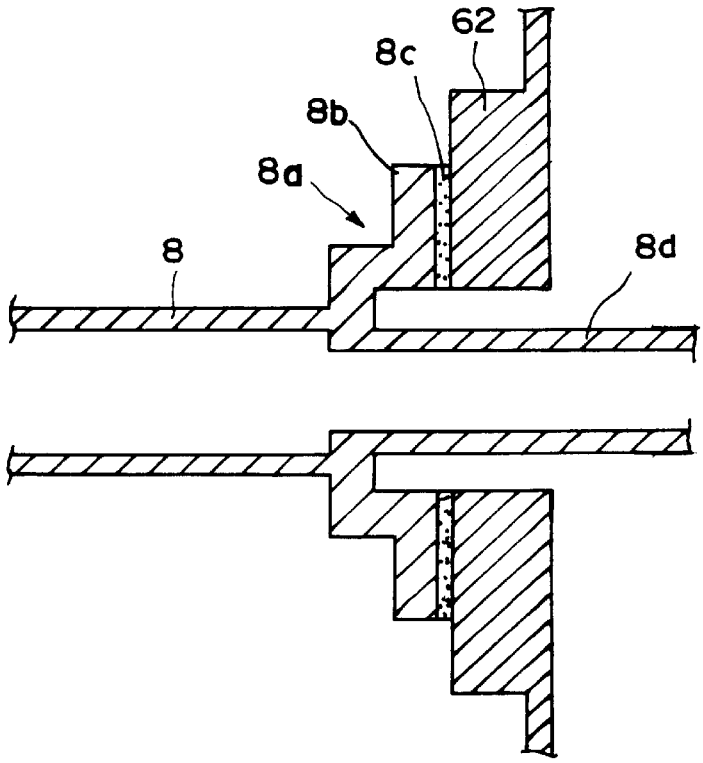
FIG. 9 shows one example of a connection structure of the gas heating apparatus of the present invention with a semiconductor treatment furnace.
Figure 10:
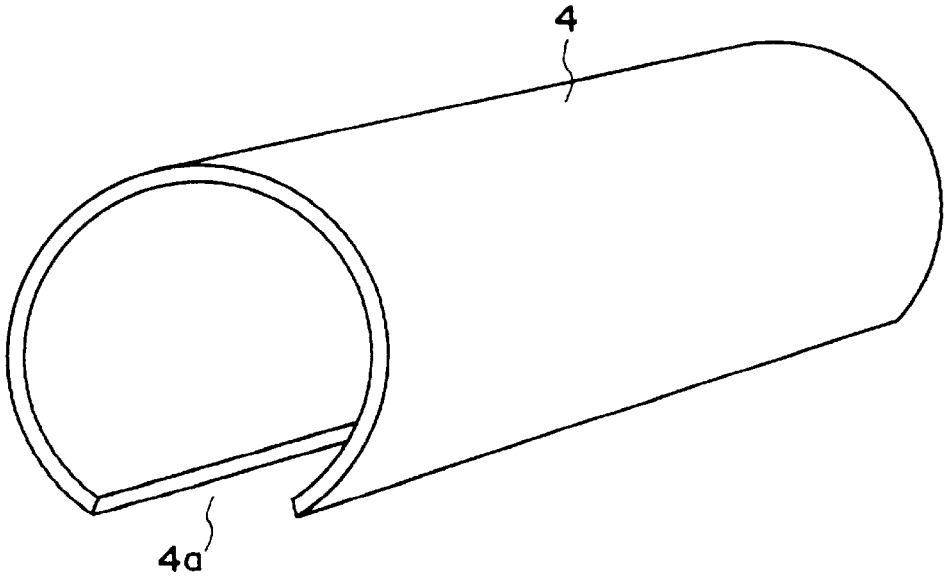
FIG. 10 is a perspective illustrating the structure of thermal shield of the gas heating apparatus shown in FIG. 1.
Figure 11:
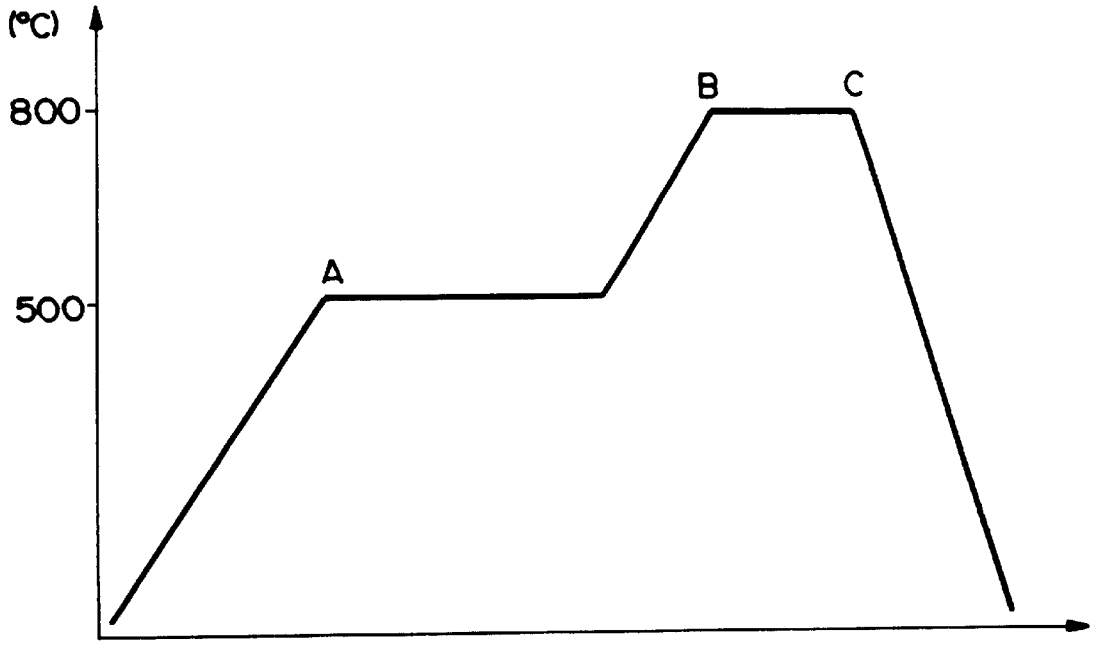
FIG. 11 is a polygonal line graph showing rise and fall of temperature-time diagram which is practiced in operation of a diffusion furnace.
Figure 12:
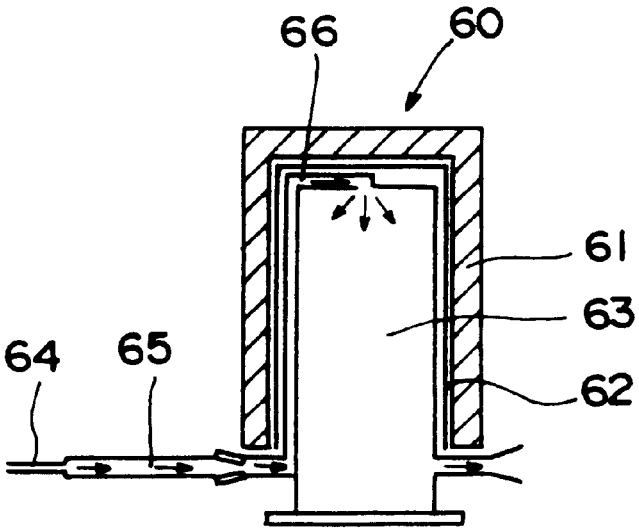
FIG. 12 shows one example of a conventional vertical batch processing oxidation furnace without gas preheating device.
Figure 13:
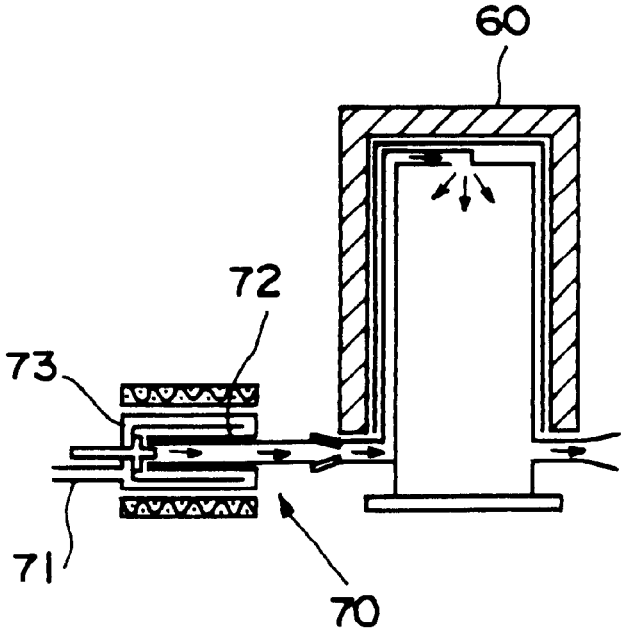
FIG. 13 shows one example of a vertical batch processing oxidation furnace with which a conventional gas preheating device is provided.
Figure 14:
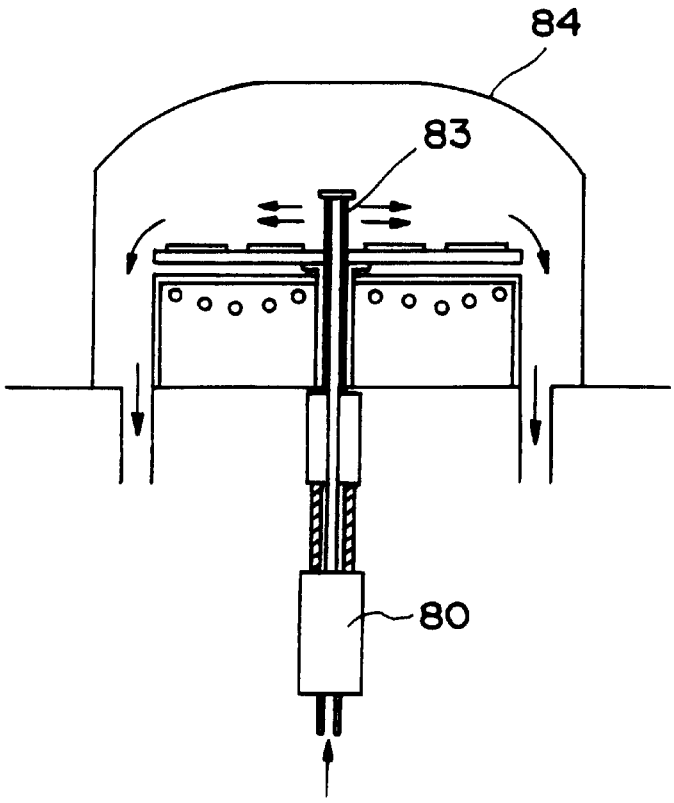
FIG. 14 shows one example of a single wafer processing belljar furnace epitaxial thin film growth system with which a conventional gas preheating device is provided.
Figure 15:
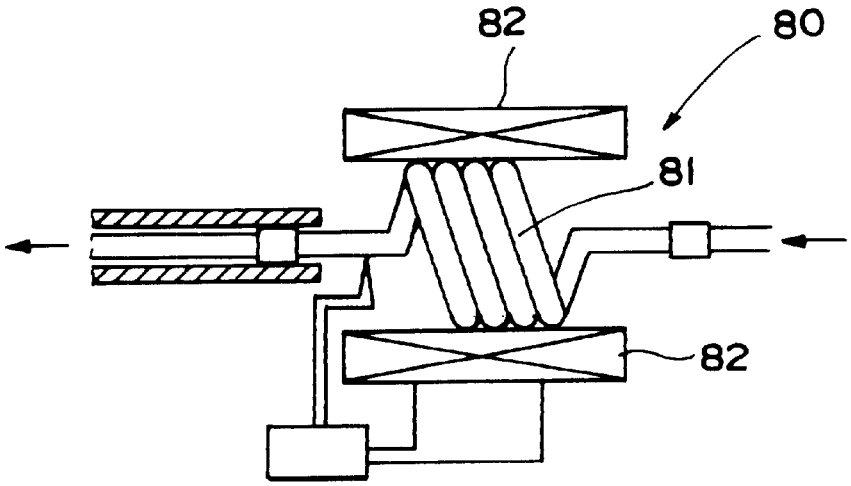
FIG. 15 is a schema illustrating structure of the gas preheating device of the system of FIG. 11.

FIG. 6 is a perspective illustrating the structure of terminal portion to be connected with the heater section. FIG. 7 is a perspective illustrating other example of the structure of terminal portion to be connected with the heater section. FIG. 8 is a schema illustrating a carbon wire heating element. FIG. 9 is a cross-sectional view showing structure of connection section for connecting the gas heating apparatus with a semiconductor treatment furnace. FIG. 10 is a schema illustrating structure of thermal shield.

The gas heating apparatus 1 in accordance with the present invention, as shown in FIG. 1, is comprised of a heating tube 2 heating gas to be supplied from a gas supply source, a heater section 3 spirally formed on an outer periphery of the heating tube 2, a thermal shield 4, made of quartz glass, in which the heating tube 2 and the heater section 3 are accommodated, a housing 5 further accommodating the thermal shield 4 accommodating the heating tube 2 and the heater section 3, high purity heat insulating material 6 arranged between the thermal shield 4 and the housing 5, a connecting tube 7 having one end connected with the gas supply source, and the other end connected with the heating tube 2, a connecting tube 8 having one end connected with the heating tube 2 and the other end connected with a semiconductor treatment furnace (not shown).

The heater section 3 is comprised of a carbon wire heating element 10 shown in FIG. 8 and a quartz glass tube 11, shown in FIG. 5, in which the carbon wire heating element 10 is enclosed. And filling 12 which act as resistance for passing gas is arranged inside the heating tube 2 as shown in FIG. 2.

Next, each member constitute in the gas heating apparatus will be described in detail.

The heating tube 2 is generally made of transparent quartz glass material approximately 1 to 3 mm thick and formed in cylindrical. And the heating tube 2 is closed by side end plates with which connecting tubes 7,8 are formed to seal after filling 12 is accommodated therein.

Here, size (effective aperture, effective length) of the heating tube 2 is suitably set in consideration of various factors such as quantity of gas to be heated, heating temperature and heat capacity of gas, however, that is generally approximately 50 to 100 mm effective diameter and approximately 100 to 200 mm in length.

And the molded matter 12*a* which is formed by welding transparent short column-like quartz glass beads or the porous quartz glass molded matter 12*b* that communicated pore is formed in foamed quartz glass as shown in FIG. 2 are used as filling 12 to be arranged inside of the heating tube 2.

In addition, the shape of quartz glass beads is not necessarily limited to short column-like shape, if the shape can absorb radiation heat to effectively add heat to the passing gas, various shapes such as spherical shape, spheroidal shape, short cylindrical shape and saddle-like shape may be employed randomly.

However, shapes which produce strain in welding and is easy to produce a crack or chip in handling or using are not preferable, and short cylindrical shape is preferable in respect to cheapness and easiness of shape processing.

And the shape of transparent quartz glass beads is made short cylindrical shape, and that is selected randomly according to pereability (ventilation resistance pressure loss), and generally, beads having a diameter of approximately 4 to 15 mm, more preferably approximately 6 to 12 mm and a length of approximately 4 to 15 mm, more preferably approximately 6 to 12 mm are used.

In particular, the molded matter formed by mixing large and small, two kinds of short cylindrical beads which are beads having a diameter of 6 to 12 mm and a length of 6 to 12 mm and breads having a diameter of 4 to 10 mm and a length of 4 to 10 mm at the number ratio of 6:4 to 8:2 to weld is preferable because that is difficult to produce damage and chip, and filling rate and gas pressure loss are suitable.

When the molded matter is produced using quartz glass beads described above, first, quartz beads of two kinds of size which are formed by cutting solid bars, made of transparent quartz glass, having a diameter of approximately 6 to 12 mm into a length of approximately 6 to 12 mm are mixed at the ratio of, for example, 7 (large size beads): 3 (small size beads) to produce beads totaled 600 to 1000 generally.

Next, these beads are filled in a quartz cylinder (heating tube) to put into cylindrical split mold made of carbon and pressed with the use of weight made of carbon, and then cylindrical molded matter is formed by heating to 1450° C. to partially weld quartz glass beads each other.

At this time, the cylindrical molded matter 12*a* is integrated with the quartz cylinder (the heating tube 2).

And permeability is added to the molded matter 12*b* comprising porous quartz glass in which communicated pore is formed in foamed quartz glass by treating cylindrical formed glass molded matter with silica matter corrosive acidic solution such as hydrofluoric acid solution or hydrofluoric acid-nitric acid solution mixed solution to partially dissolve and remove cellular wall surface and forming countless communicated holes.

Permeability of this porous quartz glass molded matter 12*b*, that is, pressure loss per processing gas flow rate is adjusted by suitably adjusting acid processing condition or the length of the molded matter.

When the porous quartz glass molded matter 12*b* is filled into the heating tube 2 as filling 12, the molded matter 12*b* is inserted into the heating tube 2 to close end surface of the heating tube 2 by side end plates, and then inside of the heating tube 2 is evacuated.

Next, filling 12 is fixed and mounted by heating and softening a portion of filling 12 from the outside of the heating tube 2 to weld inside surface of the heating tube 2 and the outer periphery surface of filling 12.

The filling 12 is not limited to the molded matter 12*a* using quartz glass beads or the porous quartz glass molded matter 12*b*, such filling which is arranged inside the heating tube 2 and have action and effect to improve heat exchange efficiency of the passing gas and does not diffuse impurity may be employed.

For example, as shown in FIG. 3, quartz glass pipes 12*c* may be employed as filling. Specifically, in the case where the heating tube 2 has a inside diameter of 77.5 mm, a length of 150 mm and a wall thickness of 5 mm, quartz glass pipes 12*c* may be function as filling by employing 61 quartz glass pipes 12*c* having outside diameter of 8.1 mm and inside diameter of 6.5 mm.

In addition, it is preferable that space between quartz glass pipes 12*c* is narrow and uniform. And when quartz glass pipes 12*c* is filled into the heating tube as filling, the same method as the case of the molded matter 12*b* can be employed.

Filling 12 formed by producing a plurality of molded matters whose permeability differ from each other to combine these molded matters may be arranged inside the heating tube 2. By combining some molded matters as filling 12, adjustment of gas pressure loss, that is, residence time of gas can be adjusted widely and easily.

For example, as shown in FIG. 4, gas disturbing plates 12*d* comprising quartz glass may be employed as filling. A plurality of opening sections 12*d*1 through which gas is passed is provided in gas disturbing plates 12*d*. And these plates 12*d* are formed and arranged so that these opening sections 12*d*1 are not corresponded to each other, as shown in FIG. 4(*b*). Therefore, gas which passed through opening sections 12*d*1 of one gas disturbing plate 12*d* strikes a next gas disturbing plate 12*d*, thereby residence time may be made long.

In gas disturbing plates 12*d*, specifically, in the case where the heating tube 2 has a inside diameter of 77.5 mm, a length of 150 mm and a wall thickness of 5 mm, gas disturbing plates 12*d* may be function as filling by employing gas disturbing plates 12*d* having outside diameter of 77.3 mm, thickness of 5 mm, a diameter of opening section of 4.5 mm and 38 opening sections (arranged in lattice-like).

In addition, when gas disturbing plates 12*d* is filled into the heating tube as filling, the same method as the case of the molded matter 12*b* can be employed.

Furthermore, a large part of heat energy transmitted from the carbon wire heating element 10 of the heater section 3 through the quartz glass tube 11 filling the element 10 into the heating tube 2 is radiation heat because heat conductance of quartz matter such as quartz glass is not large. Therefore, it is preferable that filling 12 in the heating tube 2 is transparent matter rather than black matter.

In the case where filling 12 is black matter, radiation heat is absorbed at the part of surface of black matter, thereby only the surface part is partially heated. On the other hand, in the case where filling 12 is transparent matter, irradiated radiation heat complicatedly transmit, reflect and refract to reach the center portion, therefore the inside of filling 12 may be heated uniformly. As a result, gas which pass through inside of the heating tube 2 may be heated uniformly. Accordingly, transparent alumina comprising polycrystalline Al2O3 may be employed instead of quartz glass.

This way, the gas heating apparatus that filling 12 is arranged inside the heating tube 2 can provide enough residence time to rise the temperature of gas to a predetermined temperature to introduced gas and can have gas absorb radiation heat from the heater section 3 effectively.

The heater section 3 heating the heating tube 2 will be now described below.

As described above, a heating section of the heater section 3 is comprised of the quartz glass tube 11 in which the carbon wire heating element 10 comprising carbon fiber bundle is sealed, and the heater section 3 is arranged on the surface of the heating tube 2 spirally.

This quartz glass tube 11 is comprised of a spiral quartz glass tube 11*a*, a direct tube 11*b*, made of quartz glass, supporting spiral structure of the quartz glass tube 11*a* and connected with one end of the spiral quartz glass tube 11*a*, a direct tube 11*c*, made of quartz glass, supporting spiral structure of the quartz glass tube 11*a* and connected with the other end of the spiral quartz glass tube 11*a*, as shown in FIG. 5.

The spiral quartz glass tube 11*a* is communicated with direct tubes 11*b*, 11*c*. The carbon wire heating element 10 is accommodated in the spiral quartz glass tube 11*a* and led out from direct tubes 11*b*, 11*c*.

In addition, a sealing terminal portion 20 such as shown in FIG. 6 is provided at the end portion of direct tubes 11*b*, 11*c*. Thus, the carbon wire heating element 10 led out from the spiral quartz glass tube 11*a* is connected by structure comprising the element compressively sandwiched between a plurality of wire carbon material 11*e* compressively contained in direct tubes 11*b*, 11*c*, and connecting leads (inner connecting leads) 21*a*, 21*b* of the sealing terminal portion 20 are connected with the wire carbon material 11*e*. With this structure, the end portions of the respective direct tubes 11*b*, 11*c* and the sealing terminal portion 20 are coupled such that the carbon wire heating element 10 and the plurality of wire carbon materials lie are not exposed to the open air. It is preferable that the inside of the heater structure composed of the spiral quartz glass tube, the direct tubes and the sealing terminal portion is in a quasi-vacuum state after said coupling.

The sealing terminal portion 20 is comprised of inner connecting leads 21*a*, 21*b* to be connected with the wire carbon material 11*e* accommodated in direct tubes 11*b*, 11*c*, outer connecting leads 22*a*, 22*b* to be connected with power supply not shown, a quartz glass tube 23 having a diameter which can be inserted into a large diameter quartz glass tube lid or insert the quartz glass tube lid, a quartz glass matter 24 to be accommodated and adhered with inner wall of the quartz glass tube 23, grooves 24*a* which is formed on the outer periphery surface of the quartz glass matter 24 and holds inner and outer connecting leads, Mo (molybdenum) foils 25*a*, 25*b* which are conductive foils that electrically connects inner and outer connecting leads held on the outer periphery surface of the quartz glass matter 24 and a closing member 26 closing the end portion of the quartz glass tube 23 as shown in FIG. 6.

In addition, diameters of the quartz glass tube lid and the quartz glass tube 23 are same, and these tubes may be also welded each other at the end surface thereof.

Here, inner connecting leads 21*a*, 21*b* and outer connecting leads 22*a*, 22*b* are made of Mo or W (tungsten) bar, and a diameter thereof is 1 to 3 mm. The diameter of inner connecting leads 21*a*, 21*b* and outer connecting leads 22*a*, 22*b* may be suitably selected as needed, however, small diameter is not preferable because electric resistance increase. And large diameter is not preferable because the terminal itself becomes large. Tips of inner connecting leads 21*a*, 21*b* are pointed so that these leads can be connected easily by inserting these leads into wire carbon material 11*e* compressively contained in direct tube 11*b*, 11*c*. In this case, it is preferable that depth of insertion is more than 10 mm, more preferably more than 15 mm to improve physically and electrically connectiveness with terminals 3*a*, 3*b*.

And end portion of inner connecting leads 21*a*, 21*b* and outer connecting leads 22*a*, 22*b* are accommodated in the groove 24*a*, formed on the outer periphery surface of the quartz glass matter 24, holding inner and outer connecting leads, and at this time, it is constituted so that the outer periphery surface of inner connecting leads 21*a*, 21*b* and outer connecting leads 22*a*, 22*b*, accommodated, is not excessively protruded from the outer periphery surface of the quartz glass matter 24.

In addition, when inner connecting leads 21*a*, 21*b* and outer connecting leads 22*a*, 22*b* are accommodated in the groove 24*a*, these leads are electrically insulated by the quartz glass matter 24 and electrically conducted by Mo foils 25*a*, 25*b* which are conductive foil described later.

Mo foils 25*a*, 25*b* are attached along the outer periphery surface of the quartz glass matter 24 to electrically connect inner connecting leads 21*a* and outer connecting leads 22*a* and inner connecting leads 21*b* and outer connecting leads 22*b*. In addition, fixed space S between Mo foils 25*a*, 25*b* is provided to avoid electrically short.

Further, Mo foil is used as conductive foil, however, W foil may be also used. But, use of Mo foil is preferable in respect to high flexibility.

Cement member which is Al2O3 powder-based is filled as a closing member 26 closing the end portion of the quartz glass tube 23. This cement member is formed by adding water to alumina powder to dry and cake at 200° C.

Mo foils 25*a*, 25*b* described above react with oxygen or moisture at more than 350° C. to become oxide, at this time, volume thereof expand. This closing member 26 is provided to prevent expansion of volume of Mo foils 25*a*, 25*b* and damage of the quartz glass tube 23 by intercepting outside air.

Cement using resin or SiO2 fine powder may be employed except cement (Al2O3 matter) member described above, however, use of Al2O3 powder-based cement member is preferable from the viewpoint of heat-resistance and suppression of generation of crack in drying.

Next, the other sealing terminal section will be described below base on FIG. 7.

This sealing terminal section 30 has one connecting lead 32 and attached to direct tubes 11*b*, 11*c* separately. Thus, two sealing terminal sections 30 shown in FIG. 7 are required for one heater section 3.

In order to the constitution of the sealing terminal section to be attached to the direct tube 11*b* and the constitution of that to be attached to the direct tube 11*c* are the same, the sealing terminal section to be attached to the direct tube 11*b* as an example will be described below.

A glass tube 31 constituting the sealing terminal section 30, that is, the glass tube 31 welding with the direct tube 11*b* to integrate is comprised of a quartz glass section 31*a*, a graded seal section 31*b* and a tungsten (W) glass section 31*c* from the side of weld with the direct tube 11*b*.

And a connecting lead 32, made of W, to be connected with carbon wire compressively contained in the direct tube 11*b* is pinch-sealed at a pinch-seal section 31*d* of the W glass section 31*c*.

Thus, this example is characterized that the pinch-seal section 31*d* is made of W glass whose thermal coefficient approximate to that of W constituting the connecting lead and welding side with the direct tube 11*b* is made of the quartz glass.

This way, damage of glass section (the pinch-seal section 31*d*) associated with thermal expansion in high temperature of the connecting lead 32 may be prevented because the pinch-seal section 31*d* is made of W glass whose thermal coefficient approximate to that of W constituting the connecting lead.

Further, damage associated with thermal expansion may be prevented by employing the same or equivalent quartz glass to the direct tube 11*b* as the quartz glass tube 31 welding with the direct tube 11*b* (the quartz glass section 31*a*). In addition, metallic contamination may be prevented by using high purity quartz glass.

Furthermore, this example is also characterized by the graded seal section 31*b* formed between the quartz glass section 31*a* and the W glass section 31*c*.

Thus, damage of the glass tube 31 associated with thermal expansion at the time of high temperature may be prevented by providing the graded seal section 31*b*, made of material in which thermal coefficient is gradingly distributed to the side contacting with the W glass section 31*c* so as to more approximate that of W glass after providing the side, where the components of SiO2 and W glass are gradually varied, contacting with the quartz glass section 31*a* by quartz glass or material in which thermal coefficient approximate to that of quartz glass, between the quartz glass section 31*a* and the W glass section 31*c*.

This way, in this sealing terminal section 30, the constitution of the sealing terminal section may be more simplified compared with the sealing terminal section 20, thereby the number of parts and work steps may be reduced.

Next, the carbon wire heating element 10 will be described based on FIG. 8.

This carbon wire heating element 10 is formed by bundling a plurality of carbon fiber bundle in which extra fine carbon fiber is bundled in a knitted cord-like or braid-like, and heat capacity is small, temperature characteristic is excellent, durability at high temperature is also excellent in a non-oxidative atmosphere compared with conventional heating element made of metal or SiC.

Flexibility is excellent, adaptability of shape deformation and processability are excellent compared with a heating element made of solid carbon material because the heating element 10 is formed by bundling a plurality of fine carbon single fiber bundle.

Specifically, a carbon wire heating element formed by bundling 10 bundle of fiber bundle that about 3,000 to 3500 of carbon fiber having a diameter of 7 $\mu$m are bundled in a knitted cord-like or braid-like is employed for the heating element 10.

In this case, the span of wire bundling is an approximate 2 to 5 mm. In addition, it is preferable that the knitted cord-like or braid-like carbon wire heating element 10 has raising 10*a* of carbon fiber on a surface thereof. Raising is a part that a portion of cut carbon fiber (single fiber) is protruded from the outer periphery surface of carbon wire.

It is preferable that such a carbon wire heating element 10 is inserted so that only raising 10*a* contact with inside wall of the quartz glass tube, and a body of the heating element does not contact with that substantially in the quartz glass tube 11*a*, 11*b*, 11*c*.

Accordingly, reaction between quartz glass (SiO2) and carbon (C) of the carbon wire heating element at high temperature may be restrained, also, degradation of quartz glass and reduction of durability of carbon wire may be restrained.

It is preferable that raising of surface due to carbon fiber is approximately 0.5 to 2.5 mm.

In order to realize such a constitution, inside diameter of quartz glass tube may be suitably selected for a diameter of the carbon wire heating element and the number of that.

It is preferable that carbon fiber is high purity from the viewpoint of uniformity of heating, durability, stability, avoidance of dust production, and included impurity quantity in carbon fiber is not more than 10 ppm as ash content.

More preferably, included impurity quantity in carbon fiber is not more than 3 ppm as ash content.

And it is preferable that the carbon wire heating element 10 of the heater section 3 of the present invention, as described above, is connected with the use of structure comprising the element compressively sandwiched between a plurality of wire carbon materials 11*e* the carbon wire heating element 10, and is electrically connected with the sealing terminal 20 by connecting lead via a plurality of wire carbon materials 11*e*.

Thus, a plurality of wire carbon materials 11*e* act as a temperature buffer material between the carbon wire heating element 10 and leads. Therefore, it is preferable that the number of wires is, for example, more than five times of the heating element so that electric resistance (per unit length) is less than ⅕ of the carbon wire heating element 10.

This way, since the carbon wire heating element 10 is not directly connected with leads and is connected with leads via a plurality of wire carbon materials compressively contained, if the temperature of the heating element 10 rise to high temperature, the connection between a plurality of wire carbon materials 11*e* and the carbon wire heating element 10 is not slackened. And since the temperature in the wire carbon material is decreased enough, the connection with leads is not slackened, thereby excellent electrically connection is maintained.

Furthermore, since carbon composition of a plurality of wire carbon materials 11*e* exhibit reduction action, increase in oxidation may be restrained, thereby generation of spark may be prevented.

Here, specific example of the wire carbon materials will be described. A carbon wire heating element, similar to the carbon wire heating element described above, formed by using a carbon fiber with diameter of 5 to 15 μm, for example, bundling more than 10 bundle of fiber bundle that about 3,000 to 3500 of carbon fiber having a diameter of 7 μm are bundled in a knitted cord-like or braid-like, whose diameter is about 2 mm or more, is employed for the heating element.

In this case, the span of wire bundling is a approximately 2 to 5 mm. Raising of surface due to carbon fiber is approximately 0.5 to 2.5 mm. Raising is a part that a portion of cut fiber is protruded from the outer periphery surface of carbon wire.

It is preferable that the wire carbon material described above is made of composition material similar to the carbon wire heating element in respect to a knitted cord-like or braid-like comprising a plurality of fiber bundle in which carbon fiber is bundled braided.

Here, similar composition materials mean that they preferably have similar carbon fiber diameters, number of bundled carbon fire, number of bundles of bundled fiber, the way of knitting, knitting span length, length of raising of surface, row materials thereof or the like.

In addition, it is preferable that included impurity quantity in carbon fiber is not more than 10 ppm as ash content similar to the case of the carbon wire heating element.

More preferably, included impurity quantity in carbon fiber is not more than 3 ppm as ash content.

Next, a thermal shield 4 accommodating the heating tube 2 and the heater section 3 will be described below.

The thermal shield 4 covers the heating tube 2 and the heater section 3 in order to improve heat efficiency of the heater section 3 by reflecting heat rays radiated from the heater section 3 to the outer side. This thermal shield 4 is arranged in the housing 5.

As shown in FIG. 10, this thermal shield 4 is formed in cylindrical, and a notch portion 4*a* is longitudinally formed at lower wall surface. Direct tube 11*b*, 11*c* are located at the notch portion 4*a*. Accordingly, the spiral tube 11*a* of the heater section 3 may be arranged proximity to inner surface of the thermal shield 4.

And transparent quartz glass material, opaque quartz glass material, silicon carbide and silicon carbide-silicon compound or the like are used as composition material of the thermal shield 4.

It is preferable that at least inner surface of the thermal shield 4 is covered with a reflecting heat insulating coat film. Silica fine powder and alumina fine powder, mixture of silica fine powder, alumina fine powder and titanium oxide fine powder are preferable as composition suitable for such a reflecting heat insulating coat film. More preferably, the whole surface of the cylindrical thermal shield 4 is covered with the reflecting heat insulating coat film.

Average particle size of silica fine powder, alumina fine powder and titanium oxide is approximately 0.1 to 200 μm, compounding ratio of silica fine powder and alumina fine powder is approximately 3:1 to 3:7, and in the case where titanium oxide fine powder is compounded, that is compounded at the capacity ratio of 50 to 150 part for 100 part of alumina.

This composition of the reflecting heat insulating coat film is applied to the one side (inner surface) or both side (inner surface and outer surface of cylindrical surface) by 30 to 200 μm thick to bake at approximate 1000° C. to form the reflecting heat insulating coat film. This film is difficult to degrade, peel and discolor even if the film is exposed under high temperature more than 1200° C. for a long time.

Furthermore, when film thickness is 100 μm, heat rays whose wave length is 2.5 μm may be reflected at high index of reflection more than 45%.

Surface area of the reflecting heat insulating coat film is wide due to existence of silica fine powder, alumina fine powder and titanium oxide fine powder or the like, thereby metallic impurity such as Cu may be trapped to particle interface of surface, and effect of shading, heat insulation, catch of impurity and prevention of diffusion may be obtained.

It is preferable that high purity insulating material 6 such as glass wool is filled in space between the thermal shield 4 and the housing 5 and space between the thermal shield 4 and the heater section 3.

It is preferable that the housing 5 which accommodates the thermal shield 4 therein and forms the shape of the gas heating apparatus 1 is made of quartz glass material, however, it is not limited to quartz glass material, for example, a metallic case may be use. This housing 5 is cylindrical and accommodates the heating tube 2, the heater section 3 and the thermal shield 4 to be sealed. In addition, opening sections to lead out the sealing terminal section 20 for connecting tubes 7, 8 and the heater section 3 are provided at the side end face of the housing 5.

In order to reduce fall of gas temperature due to radiation of heat from connecting part, fall of thermal efficiency of furnace and confusion of temperature distribution, connection portion 8*a* to be connected with the semiconductor heating treatment furnace is provided with connecting structure as shown in FIG. 9.

Thus, connection portion 8*a* is comprised of flange portion 8*b* made of opaque quartz glass material and inserting tube 8*d*. Seal surface 8*c* of flange portion 8*b* abutting with flange 62 of the semiconductor heating treatment furnace is formed by padding transparent quartz glass to flange portion 8*b*.

This way, since seal surface 8*c* is formed by padding of transparent quartz glass, ability of seal is improved, and since flange portion 8*b* is made of opaque quartz glass material, heat insulation properties and ability of shading are improved.

And it is not necessary to make flange portion 8*b* by opaque quartz glass material, when flange portion 8*b* is made by transparent quartz glass, it is not necessary to form seal surface 8*c* by padding of transparent quartz glass to the flange portion 8*b*.

In the gas heating apparatus of the present invention, with respect to except above-described component member, structure, for example, connection member with gas supply source, heat temperature control mechanism of a heat exchanger, well known member, mechanism itself may be employed.

In above description, with respect to the fluid heating apparatus of the present invention, in particular, the case where gas is used as fluid is described, however, pure water may be also employed instead of gas, in this case, similar action and effect may be obtained.

EXAMPLE 1

Figure 16:
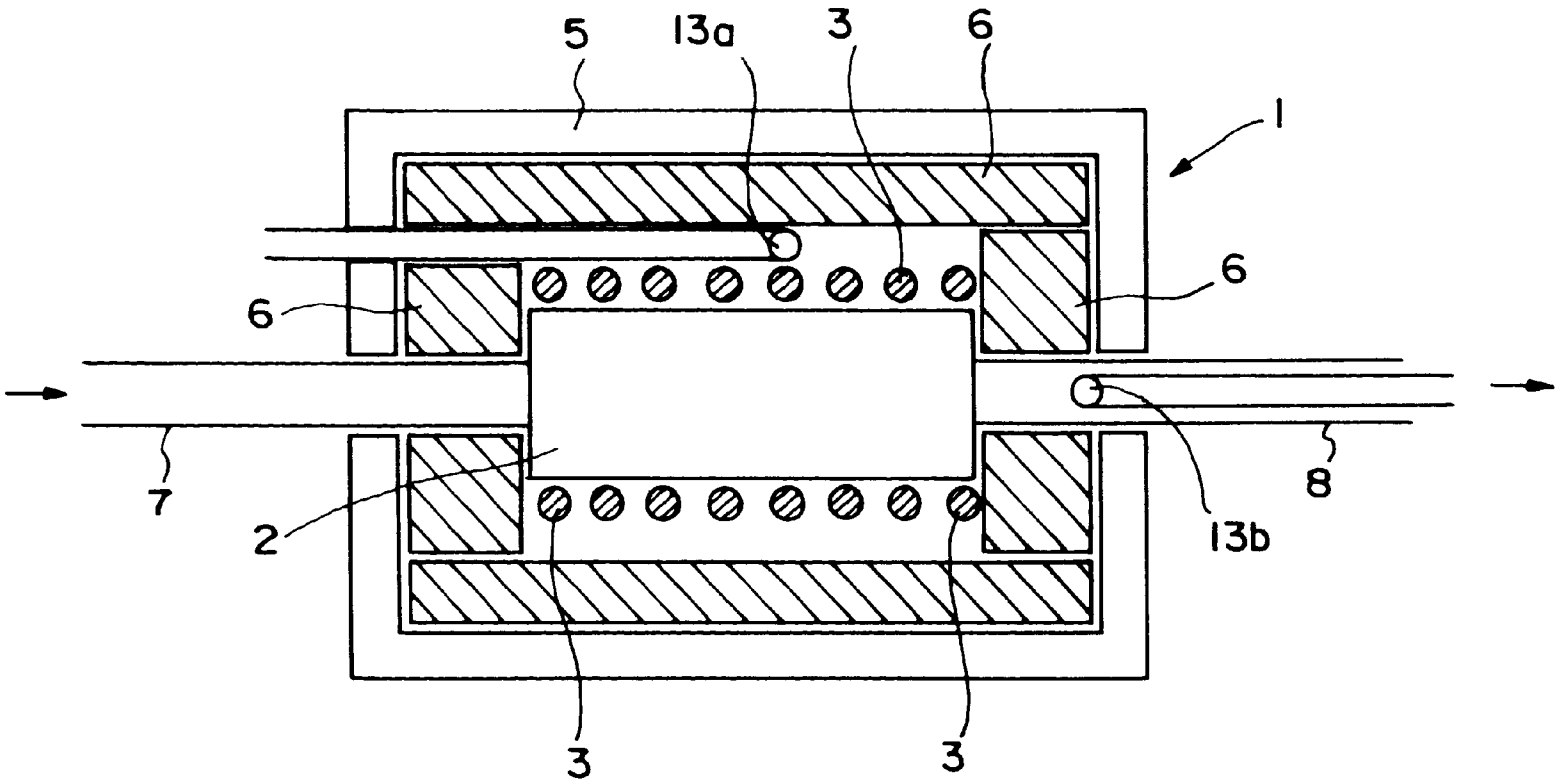
FIG. 16 shows other embodiment (used in the example) of a gas heating apparatus according to the present invention.

A gas heating apparatus (FIG. 16), according to the present invention, having specification described below is produced. In FIG. 16, the same members corresponding to members shown in FIG. 1 are denoted by the same reference numerals.

Specification of the gas heating apparatus;

- a housing 5: cylindrical housing made of quartz glass (length 220 mm diameter 160 mm),
- a heater section 3: 30,000 of 7 $\mu$m carbon fiber are bundled to be 2 mm to form carbon wire heating element by bundling 3 knitted cord bundle,
- a quartz glass tube (5 mm): a spiral tube has the whole heater structure including a direct tube with radius of curvature of 40 mm (FIG. 5) and sealing terminal portions (FIG. 1),
- a heating tube 2: transparent quartz glass-made
- filling 12: molded matter formed by mixing and filling about 800 of 8×8 mm transparent short cylindrical quartz glass beads and about 200 of 6×6 mm transparent short cylindrical quartz glass beads into split mold and partially welding under heat pressure (porosity=34%)
- insulating material 6 in the housing: high purity insulating material SiO2: Al2O3=3:7 of fiber (Fe≦10 ppm, Cu≦0.5 ppm, Ni≦0.5 ppm, Na≦50 ppm, the whole metal impurity included quantity≦150 ppm )

In the gas heating apparatus of FIG. 16, measurements of gas-out temperature is made when predetermined flow rate (0, 5, 10, 20 slm of gaseous nitrogen is introduced from the gas introducing tube (connecting tube) 7 into the heating tube 2 in which filling 12 is arranged after the heater is heated by applying power to the heater so that heater temperature become 1,000.

Here, heater temperature shows measured temperature by use of a thermoelement 13*a* that a tip thereof is non-contactingly arranged near the heater. And out-gas temperature is measured temperature by use of a thermoelement 13*b* that a tip thereof is arranged near the heating tube 2 in the gas discharge tube (connecting tube) 8.

This result is shown in table 1 with stabilized time until needed power and current value are stabilized within ±0.2 A.

TABLE 1

| flow rate (slm) | 0 | 5 | 10 | 20 |
|---|---|---|---|---|
| heater temperature (° C.) | 1000 | 1000 | 1000 | 1000 |
| out-gas temperature (° C.) | 320.0 | 888.0 | 927.0 | 977.5 |
| power (w) | 813 | 900 | 978 | 1150 |
| stabilized time (sec) | — | 480 | 678 | 1032 |

Due to the table 1, in accordance with the present invention, gas heating may be possible with comparatively low power about 1,000 W at very high thermal efficiency.

And, in accordance with the present invention, the size of the gas heating apparatus is limited to the size of length of 220 mm×diameter 160 mm, thereby it is more easy to miniaturize. And it is ascertained that high purity of discharged gas from the gas heating apparatus is not lost even after continuation heating of 1,000 hours. Furthermore, damage and degradation of members is not ascertained after continuation heating of 1,000 hours.

EXAMPLE 2

The same estimate as the example 1 is made except filling arranged in the heating tube used in the example 1 has apparent specific gravity of 0.5 g /cm3 and porosity of 80%. This result is shown in a table 2.

TABLE 2

| flow rate (slm) | 0 | 5 | 10 | 20 |
|---|---|---|---|---|
| heater temperature (° C.) | 1000 | 1000 | 1000 | 1000 |
| out-gas temperature (° C.) | 315.5 | 942.7 | 977.8 | 1015.5 |
| power (w) | 822 | 933 | 1037 | 1283 |
| stabilized time (sec) | — | 294 | 538 | 518 |

Due to the table 2, in accordance with the present invention, gas heating may be possible with comparatively low power about 1,000 W at very high thermal efficiency.

And, in accordance with the present invention, after continuation heating of 1,000 hours, high purity of discharged gas from the gas heating apparatus is maintained without impurity contamination, and damage and degradation of members is not ascertained.

In addition, the gas heating apparatus in accordance with the present invention may be employed as the heating apparatus for reaction gas such as oxidative gas, reducing gas and inert gas, process gas, or atmosphere gas generally.

As described above, the fluid heating apparatus according to the present invention has excellent durability and can suppress generation of particle and the like or metallic contamination and the like, and it is possible to provide a fluid heating apparatus which can be miniaturized and a semiconductor heating treatment furnace provided with this apparatus.

What is claimed is:

1. A fluid heating apparatus comprising at least a heating tube heating fluid to be supplied from fluid supply source, a heater section spirally formed on an outer periphery of the heating tube and a housing accommodating the heating tube and the heater section, wherein said heater section comprises a carbon wire heating element and a quartz glass tube in which said carbon wire heating element is enclosed.

2. A fluid heating apparatus according to claim 1, wherein filling which act as resistance for passing fluid is arranged inside said heating tube.

3. A fluid heating apparatus according to claim 2, wherein said filling comprises a molded matter formed by welding short column-like quartz glass beads or a porous quartz glass molded matter in which communicated pore is formed.

4. A fluid heating apparatus according to claim 3, wherein said molded matter formed by welding short column-like quartz glass beads is the molded matter formed by mixing large and small, two kinds of beads, those beads having a diameter of 6 to 12 mm and a length of 6 to 12 mm and having a diameter of 4 to 10 mm and a length of 4 to 10 mm at the number ratio of 1:4 to 4:1 to weld.

5. A fluid heating apparatus according to claim 2, wherein said filling comprises a plurality of quartz glass pipes.

6. A fluid heating apparatus according to claim 2, wherein said filling comprises a gas disturbing plate, made of quartz glass, having a plurality of opening sections.

7. A fluid heating apparatus according to claim 6, wherein a plurality of gas disturbing plates are accommodated inside the heating tube, and plates are constituted so that opening sections of neighboring gas disturbing plates are not corresponded to each other at least.

8. A fluid heating apparatus according to claim 1, wherein high purity heat insulating material is filled in space between said heater section and said housing.

9. A fluid heating apparatus according to claim 1, wherein said heating tube and said heater section are accommodated in a thermal shield provided in the housing.

10. A fluid heating apparatus according to claim 9, wherein said thermal shield is cylindrical, and a reflecting heat insulating coat film including silica fine powder and alumina fine powder is formed at least inside surface thereof.

11. A fluid heating apparatus according to claim 10, wherein said reflecting heat insulating coat film comprises composition whose compounding ratio between said silica fine powder and said alumina fine powder is parts by capacity of 3:1 to 3:7.

12. A fluid heating apparatus according to claim 10, wherein said reflecting heat insulating coat film further includes titanium oxide fine powder.

13. A fluid heating apparatus according to claim 10, wherein film thickness of said reflecting heat insulating coat film is within the range of 30 to 200 $\mu$m.

14. A fluid heating apparatus according to claim 9, wherein high purity heat insulating material is filled in space between said thermal shield and said housing.

15. A fluid heating apparatus according to claim 1, wherein said carbon wire heating element is a knitted cord-like or braid-like carbon wire heating element comprising a plurality of fiber bundle wherein carbon fiber having a diameter of 5 to 15 $\mu$m is bundled braided.

16. A fluid heating apparatus according to claim 15, wherein included impurity quantity of carbon fiber in said carbon wire heating element is not more than 10 ppm as ash content.

17. A fluid heating apparatus according to claim 1, claim 15 or claim 16, wherein a porous molded matter formed by partially welding a plurality of quartz glass beads is arranged inside said heating tube.

18. A fluid heating apparatus according to claim 17, wherein said heating tube and said heater section are accommodated in heat insulating material provided in the housing.

19. A fluid heating apparatus according to claim 11, wherein said reflecting heat insulating coat film further includes titanium oxide fine powder.

20. A fluid heating apparatus according to claim 11, wherein film thickness of said reflecting heat insulating coat film is within the range of 30 to 200 $\mu$m.

21. A fluid heating apparatus according to claim 10, wherein high purity heat insulating material is filled in space between said thermal shield and said housing.

22. A fluid heating apparatus according to claim 11, wherein high purity heat insulating material is filled in space between said thermal shield and said housing.

* * * * *